US009041495B2

(12) United States Patent
Wong

(10) Patent No.: US 9,041,495 B2
(45) Date of Patent: May 26, 2015

(54) CAVITY FILTER WITH CONNECTING STRUCTURE CONNECTED BETWEEN SLIDER AND DRIVING DEVICE

(71) Applicant: HON HAI PRECISION INDUSTRY CO., LTD., New Taipei (TW)

(72) Inventor: Kwo-Jyr Wong, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 169 days.

(21) Appl. No.: 13/912,290

(22) Filed: Jun. 7, 2013

(65) Prior Publication Data

US 2014/0292445 A1 Oct. 2, 2014

(30) Foreign Application Priority Data

Mar. 29, 2013 (CN) ..... 2013 1 01086128

(51) Int. Cl.
*H01P 3/06* (2006.01)
*H01P 1/205* (2006.01)

(52) U.S. Cl.
CPC ..... *H01P 1/2053* (2013.01)

(58) Field of Classification Search
None
See application file for complete search history.

(56) References Cited

U.S. PATENT DOCUMENTS

| | | | | |
|---|---|---|---|---|
| 6,255,922 | B1 | 7/2001 | Malmstrom et al. | |
| 8,294,536 | B2 * | 10/2012 | Wong | 333/203 |
| 2013/0234807 | A1 | 9/2013 | Wong | |

FOREIGN PATENT DOCUMENTS

| | | | |
|---|---|---|---|
| EP | 0558850 | A2 | 9/1993 |
| TW | M438039 | U1 | 9/2012 |
| TW | M446683 | U1 | 2/2013 |

* cited by examiner

*Primary Examiner* — Cassandra Cox
(74) *Attorney, Agent, or Firm* — Novak Druce Connolly Bove + Quigg LLP

(57) ABSTRACT

A cavity filter includes a slider, a driving device, and an adapter. The slider is used to slide relative to and couple with a plurality of resonators located in the cavity filter to adjust a resonating frequency of the cavity filter. The driving device is used to drive the slider slide relative to the plurality of resonators and includes a shaft having a free end. The adapter is installed between the slider and the driving device and rotateably connected to the free end of the shaft with a gap configured between the free end and the adapter.

16 Claims, 7 Drawing Sheets

CAVITY FILTER WITH CONNECTING STRUCTURE CONNECTED BETWEEN SLIDER AND DRIVING DEVICE

BACKGROUND

1. Technical Field

The disclosure relates to cavity filters, and more particularly relates to a connecting structure between a slider and a driving device in a cavity filter.

2. Description of Related Art

Cavity filters are popularly used in mobile communications. Generally, a cavity filter comprises a shell, a slider, a plurality of resonators, and a motor. The slider is movably connected to the shell and opposite to the plurality of resonators arranged in the shell. The motor drives the slider to move relative to the shell and couples with the resonators to adjust resonating frequency of the cavity filter. Generally, the slider is fixed to the motor by fasteners, such as screws. However, vibration of the motor and no so good fixture cause the slider to deviate from a linear path, which makes the slider not able to move on an even keel linearly, thereby reducing precision of adjusting the resonating frequency of the cavity filter.

Therefore, a need exists in the industry to overcome the described limitations.

BRIEF DESCRIPTION OF THE DRAWINGS

Many aspects of the present embodiments can be better understood with reference to the following drawings. The components in the drawings are not necessarily drawn to scale, the emphasis instead being placed upon clearly illustrating the principles of the present embodiments. Moreover, in the drawings, all the views are schematic, and like reference numerals designate corresponding parts throughout the several views.

DETAILED DESCRIPTION

The disclosure is illustrated by way of example and not by way of limitation in the figures of the accompanying drawings in which like references indicate similar elements. It should be noted that references to "an" or "one" embodiment in this disclosure are not necessarily to the same embodiment, and such references mean at least one.

Figure 1:
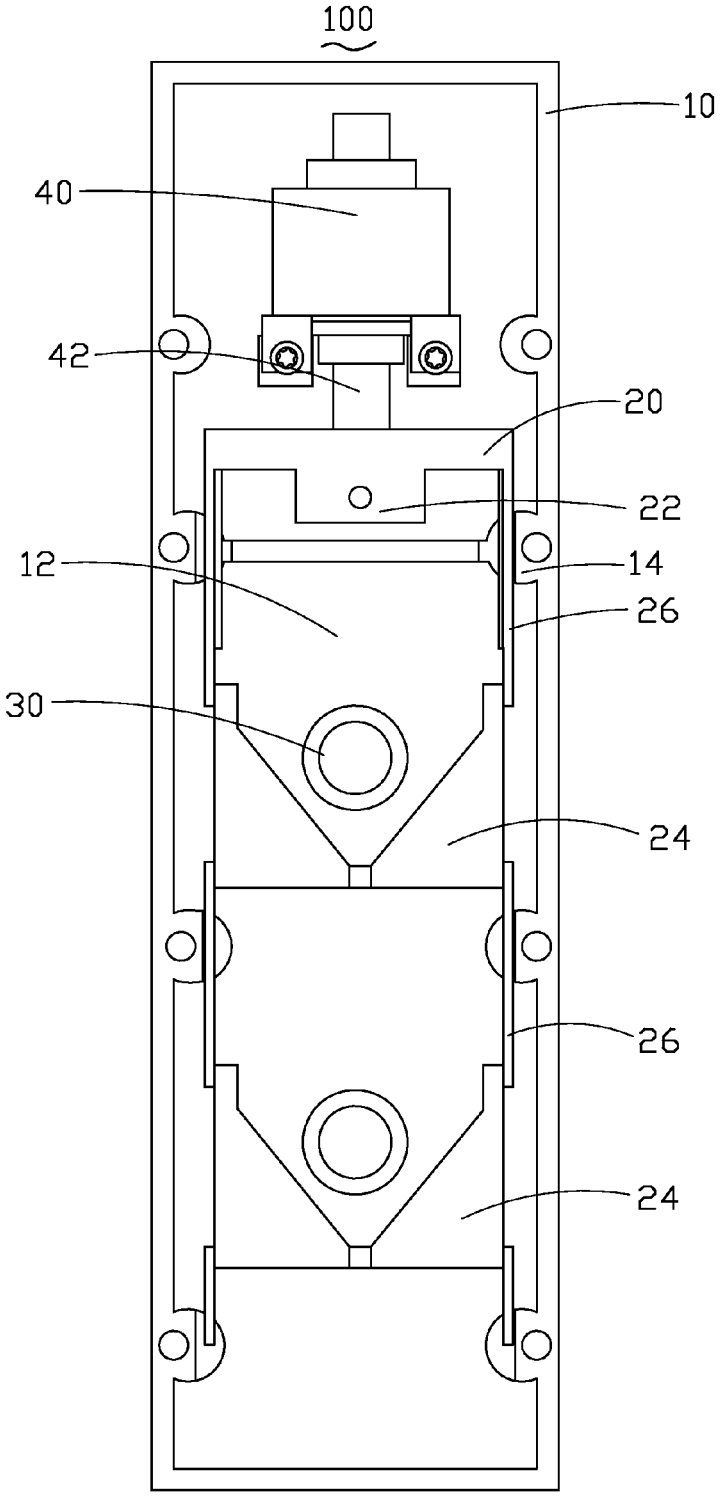
FIG. 1 is a schematic diagram of a cavity filter in accordance with a first exemplary embodiment of the disclosure, in which a plurality of resonators, a driving device, and a slider are secured in a shell of the cavity filter.
Figure 2:
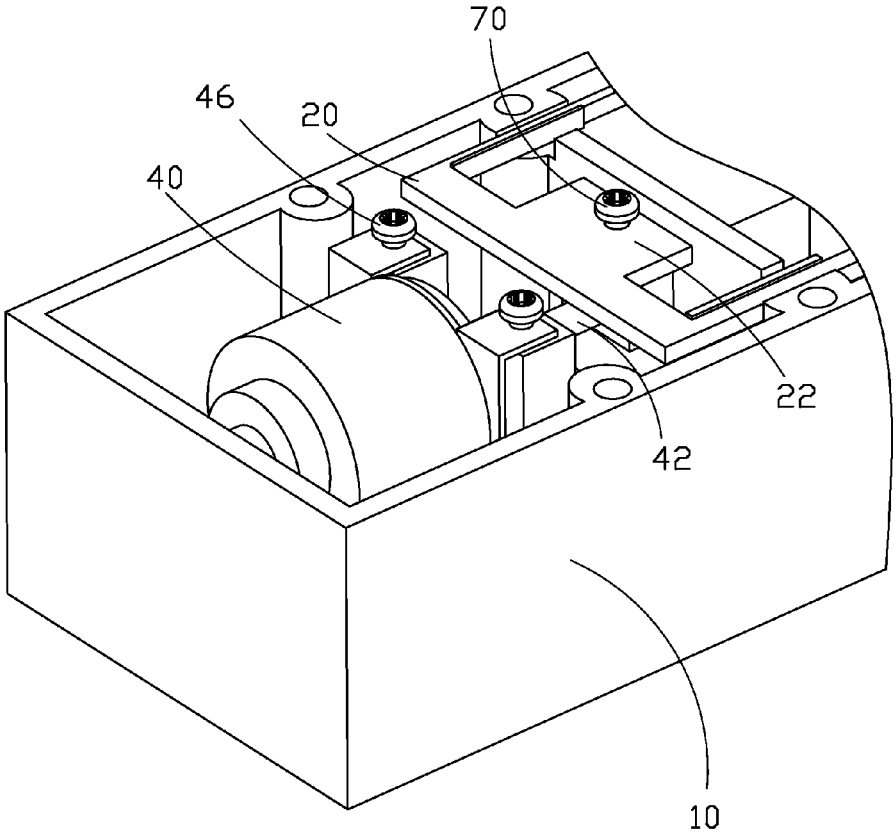
FIG. 2 is a partially perspective view of the cavity filter of FIG. 1.
Figure 3:
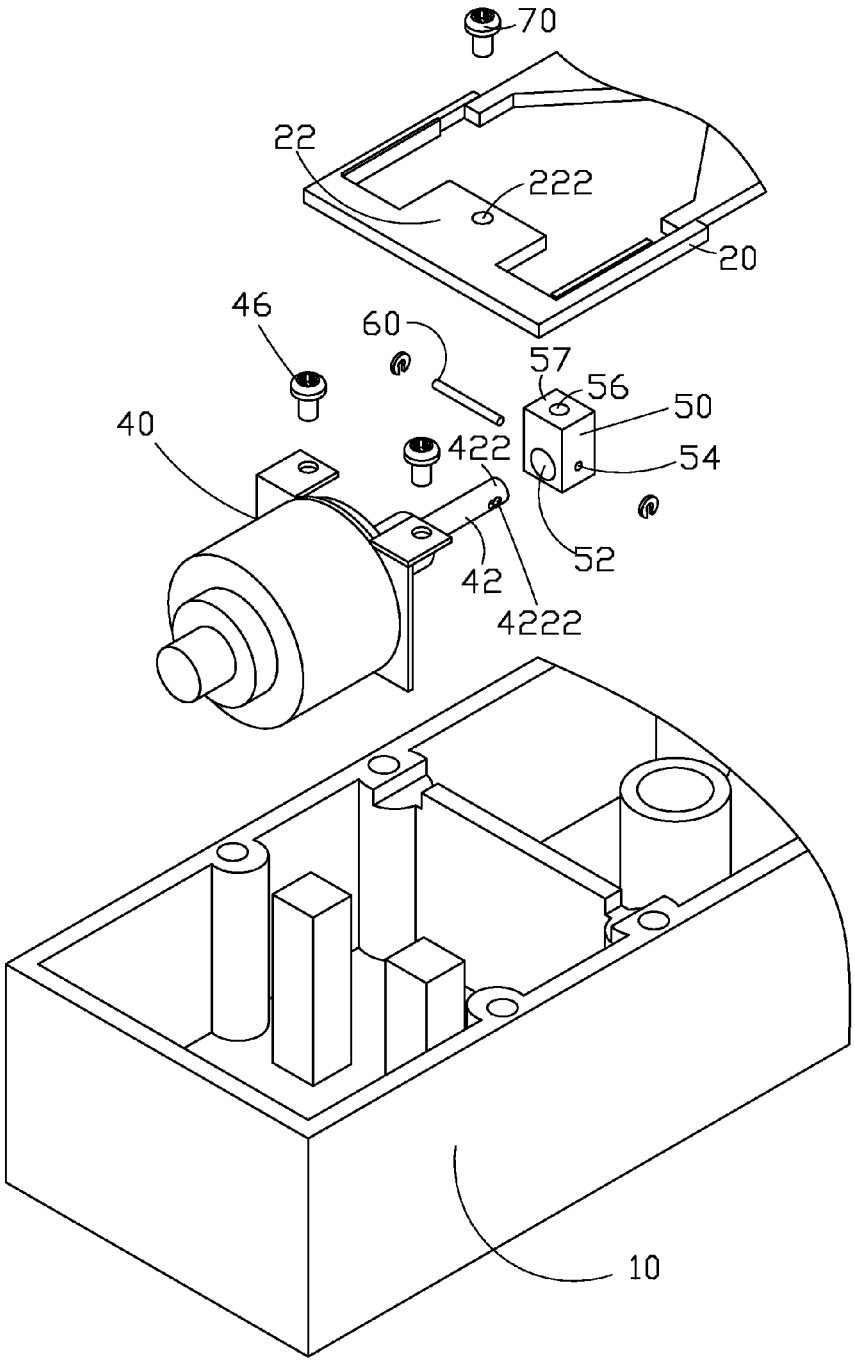
FIG. 3 is a disassembled perspective view of FIG. 2.

In FIGS. 1-3, the cavity filter 100 comprises a shell 10, a slider 20, a plurality of resonators 30 secured in the shell 10, a driving device 40 for driving the slider 20 to slide relative to and couple with the resonators 30 to adjust a resonating frequency of the cavity filter 100, and an adapter 50. The cavity filter 100 defines a cavity 12 surrounded by the shell 10. The shell 10 comprises a plurality of positioning portions 14 arranged in two rows opposite to each other. The plurality of resonators 30 are arranged in the cavity 12 and fixed to the shell 10. In this embodiment, the plurality of resonators 30 are arranged in a row and located between the two rows of the positioning portions 14. The slider 20 comprises a fixing portion 22, a plurality of tuning portions 24 and a plurality of connecting portions 26. The fixing portion 22 is configured at one end of the slider 20 close to the driving device 40. The plurality of tuning portions 24 are respectively opposite to the resonators 30. In this embodiment, the cavity filter 100 includes two resonators 30, accordingly, the slider 20 includes two tuning portions 24 respectively positioned above the resonators 30. The plurality of connecting portions 26 arranged in two rows opposite to each other are positioned on the two rows of the positioning portions 14. Two of the connecting portions 26 are connected between the fixing portion 22 and one of the resonators 30 adjacent to the fixing portion 22, and others of the connecting portions 26 are connected between the resonators 30.

The driving device 40 is fixed in the shell 10 by screws 46 and comprises a shaft 42 parallel to the slider 20. In assembly, the fixing portion 22 is located above the shaft 42. The adapter 50 is installed between the fixing portion 22 and the shaft 42. In this embodiment, the driving device 40 is a step motor, but the disclosure is not limited thereto. When the driving device 40 is powered on, the shaft 42 moves along an axial direction of the shaft 42, thereby the slider 20 move on the plurality of positioning portions 14 and coupling with the resonators 30 to adjust a resonating frequency of the cavity filter 100.

Figure 4:
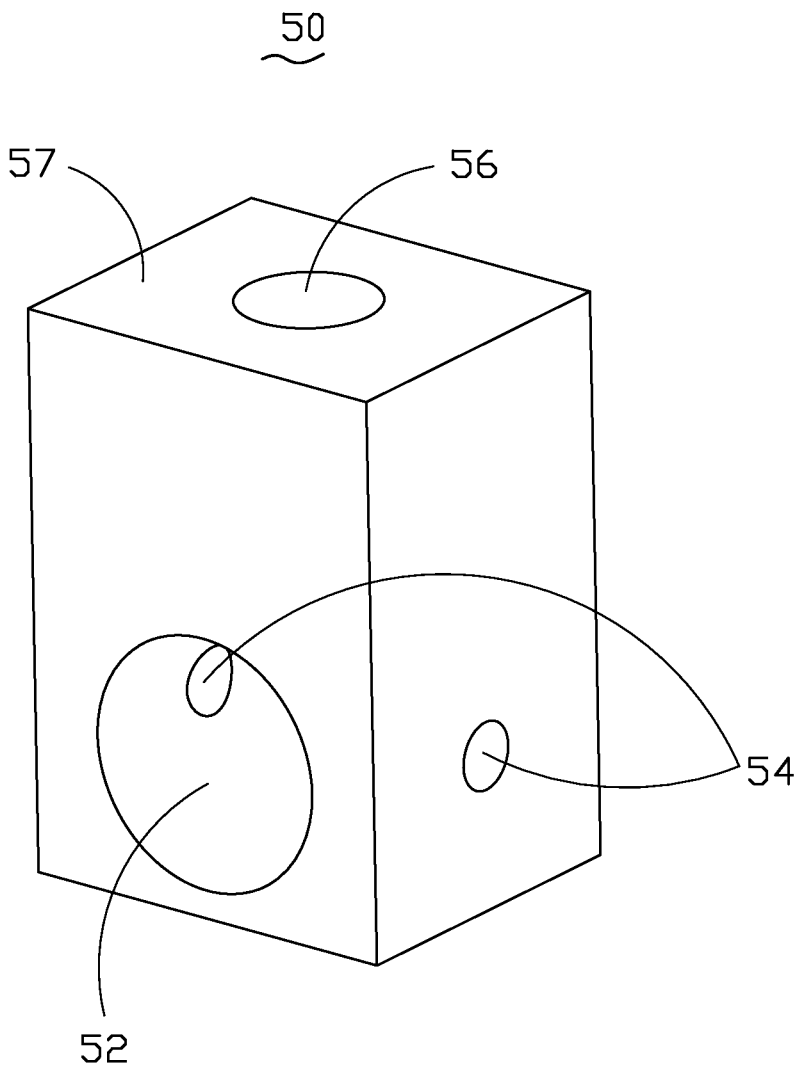
FIG. 4 is a perspective view of an adapter of the cavity filter.

The shaft 42 of the driving device 40 includes a free end 422 defining a positioning hole 4222 extending along a radial direction of the shaft 42. In FIG. 4, the adapter 50 defines a receiving room 52 used to accommodate the free end 422, a pair of fixing holes 54 communicating to the receiving room 52 and a screw hole 56. The adapter 50 includes a contacting surface 57 used to contact to the slider 20.

Figure 5:
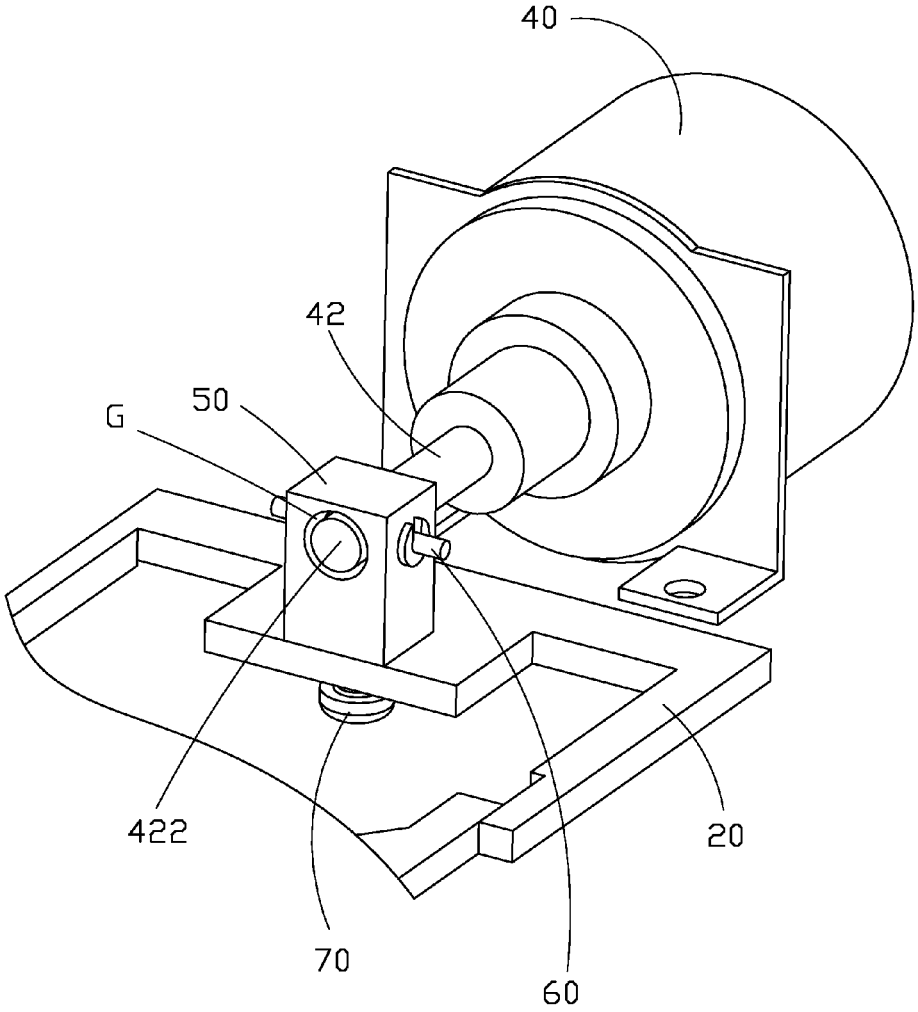
FIG. 5 is a partially perspective view of the cavity filter, showing relationship between the adapter and the driving device of the cavity filter.
Figure 6:
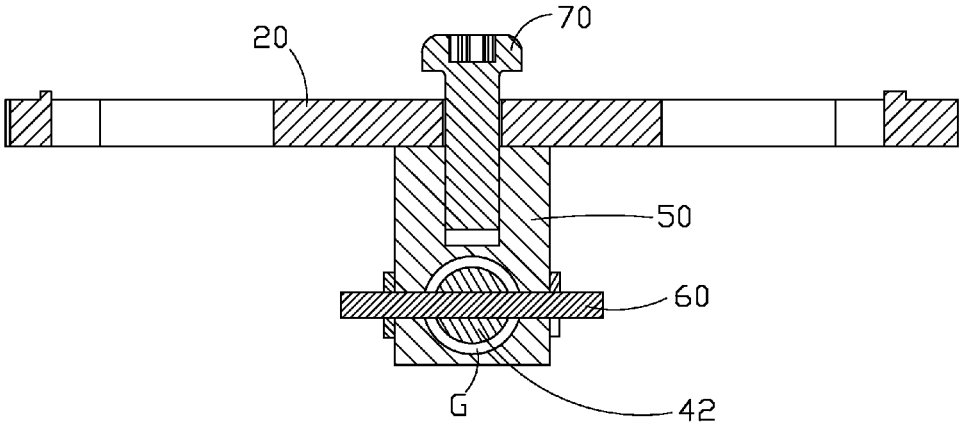
FIG. 6 is a first cross sectional view of the cavity filter.
Figure 7:
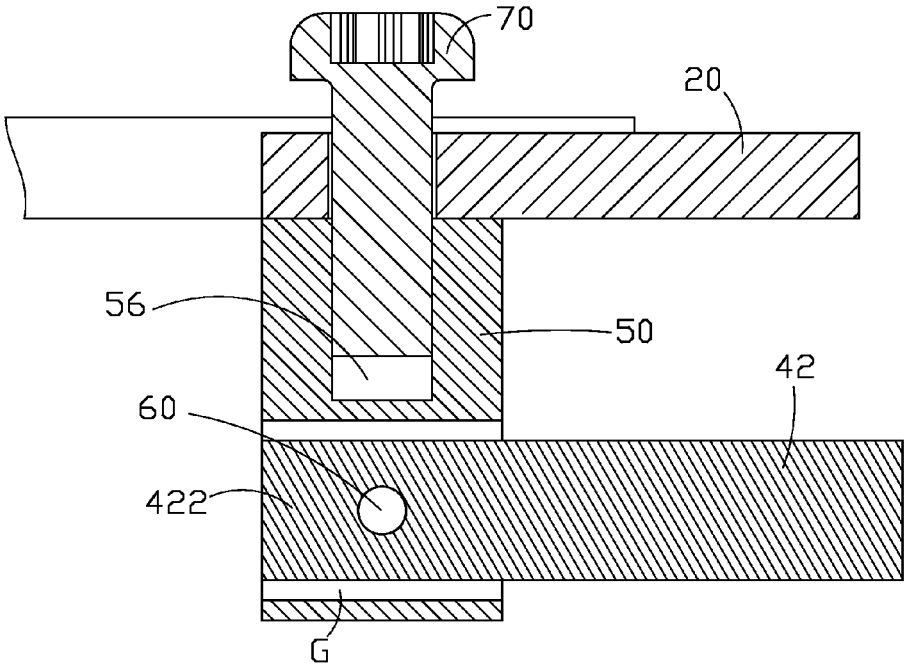
FIG. 7 is a second cross sectional view of the cavity filter.

In FIGS. 5-7, the free end 422 of the shaft 42 is rotateably connected to the adapter 50 with a gap G configured between the free end 422 and the adapter 50. The free end 422 is inserted into the receiving room 52 of the adapter 50. The gap G is annular shaped. The positioning hole 4222 of the free end 422 is opposite to the pair of fixing holes 54. A pin 60 passes through one of the pair of fixing holes 54, the positioning hole 4222 and the other one of the pair of fixing holes 54 in turn, to rotateably connect the free end 422 of the shaft 42 to the adapter 50. In this embodiment, the pin 60 is interferingly fixed to free end 422 of the shaft 42, and connected to the adapter 50 with clearance fit. In assembly, the pin 60 can rotate in the pair of fixing holes 54 of the adapter 50 freely.

When the driving device 40 is powered on, vibrations of the shaft 42 along a radial direction are created during moving of the shaft 42. The free end 422 can rotate about the pin 60 in the receiving room 50 due to the vibrations of the shaft 42. Therefore, movement of the adapter 50 is not influenced by the vibrations of the shaft 42 and can not deform the slider 20. That is, the gap G configured between the free end 422 and the adapter 50 absorbs the vibrations of the free end 422 of the shaft 42. Therefore, the slider 20 can move on an even keel linearly on the plurality of positioning portions 14 without vibrations and deformation. That is the slider 20 is snugly supported on the plurality of positioning portions 14 constantly during moving, thereby improving precision of adjusting of the resonating frequency of the cavity filter 100.

In this embodiment, the fixing portion 22 of the slider 20 defines a through hole 222. The adapter 50 is fixed to the fixing portion 22 of the slider 20 by a screw 70 passing through the through hole 222 and screwed into the screw hole 56, thereby the slider 20 is connected to the adapter 50. The contacting surface 57, configured as a flat surface or a curved surface, entirely contacts with the slider 20 to make a stable connecting structure between the adapter 50 and the slider 20.

While various embodiments and methods of the present disclosure have been described above, it should be understood that they have been presented by way of example only and not by way of limitation. Thus the breadth and scope of the present disclosure should not be limited by the above-described embodiments, but should be defined only in accordance with the following claims and their equivalents.

What is claimed is:

1. A cavity filter, comprising:

a slider, sliding relative to and coupled with a plurality of resonators located in the cavity filter to adjust a resonating frequency of the cavity filter;

a driving device, driving the slider to slide relative to the plurality of resonators, the driving device comprising a shaft parallel to the slider, the shaft comprising a free end; and an adapter, installed between the slider and the driving device and rotateably connected to the free end of the shaft with a gap configured between the free end and the adapter, the gap absorbing vibrations of the free end, allowing the slider to move on an even keel during adjustment of the resonating frequency.

2. The cavity filter as claimed in claim 1, wherein the driving device is a step motor.

3. The cavity filter as claimed in claim 2, wherein the adapter defines a receiving room, the free end is inserted into the receiving room and rotateably connected to the adapter.

4. The cavity filter as claimed in claim 3, wherein the adapter defines a pair of fixing holes communicating to the receiving hole, the free end defines a positioning hole extending along a radial direction of the shaft, a pin passes through one of the pair of fixing holes, the positioning hole and the other one of the pair of fixing holes in turn, the pin is interferingly fixed to the free end and connected to the adapter with a clearance fit.

5. The cavity filter as claimed in claim 1, wherein the gap is annular shaped.

6. The cavity filter as claimed in claim 1, wherein the slider defines a through hole, the adapter defines a screw hole opposite to the through hole, the adapter is fixed to the slider by a screw passing through the through hole and screwed into the screw hole.

7. The cavity filter as claimed in claim 6, wherein the adapter comprises a contacting surface configured as a flat surface and used to entirely contact with the slider in assembly.

8. The cavity filter as claimed in claim 6, wherein the adapter comprises a contacting surface configured as a curved surface and used to entirely contact with the slider in assembly.

9. A cavity filter, comprising:

a shell, comprising a plurality of positioning portions arranged in two rows opposite to each other;

a plurality of resonators, fixed in the shell and arranged in a row and locked between the two rows of the positioning portions;

a slider, positioned on the plurality of positioning portions, and comprising a plurality of tuning portions located above the plurality of resonators and used to couple to the plurality of resonators to adjust a resonating frequency of the cavity filter;

a driving device, driving the slider slide relative to the plurality of resonators, the driving device comprising a shaft parallel to the slider, the shaft comprising a free end; and an adapter, installed between the slider and the driving device and rotateably connected to the free end of the shaft with a gap configured between the free end and the adapter.

10. The cavity filter as claimed in claim 9, wherein the driving device is a step motor.

11. The cavity filter as claimed in claim 10, wherein the adapter defines a receiving room, the free end is inserted into the receiving room and rotateably connected to the adapter.

12. The cavity filter as claimed in claim 11, wherein the adapter defines a pair of fixing holes communicating to the receiving hole, the free end defines a positioning hole extending along a radial direction of the shaft, a pin passes through one of the pair of fixing holes, the positioning hole and the other one of the pair of fixing holes in turn, the pin is interferingly fixed to the free end and connected to the adapter with clearance fit.

13. The cavity filter as claimed in claim 9, wherein the gap is annular shaped.

14. The cavity filter as claimed in claim 9, wherein the slider defines a through hole, the adapter defines a screw hole opposite to the through hole, the adapter is fixed to the slider by a screw passing through the through hole and screwed into the screw hole.

15. The cavity filter as claimed in claim 14, wherein the adapter comprises a contacting surface configured as a flat surface and used to entirely contact with the slider in assembly.

16. The cavity filter as claimed in claim 14, wherein the adapter comprises a contacting surface configured as a curved surface and used to entirely contact with the slider in assembly.

* * * * *